US009454901B2

(12) United States Patent
Liu et al.

(10) Patent No.: US 9,454,901 B2
(45) Date of Patent: Sep. 27, 2016

(54) METHOD AND DEVICE FOR MONITORING REAL-TIME ROAD CONDITION

(71) Applicant: LAUNCH TECH CO., LTD., Shenzhen, Guangdong (CN)

(72) Inventors: Jun Liu, Shenzhen (CN); Jiangbo Zhang, Shenzhen (CN); Lin Lv, Shenzhen (CN)

(73) Assignee: LAUNCH TECH CO., LTD., Shenzhen (CN)

( * ) Notice: Subject to any disclaimer, the term of this patent is extended or adjusted under 35 U.S.C. 154(b) by 0 days.

(21) Appl. No.: 14/771,739

(22) PCT Filed: Jan. 15, 2015

(86) PCT No.: PCT/CN2015/070719

§ 371 (c)(1),
(2) Date: Aug. 31, 2015

(87) PCT Pub. No.: WO2015/188621

PCT Pub. Date: Dec. 17, 2015

(65) Prior Publication Data

US 2016/0196742 A1 Jul. 7, 2016

(30) Foreign Application Priority Data

Jun. 10, 2014 (CN) ..... 2014 1 0256474

(51) Int. Cl.
*G08G 1/00* (2006.01)
*G08G 1/01* (2006.01)
*G08G 1/052* (2006.01)

(52) U.S. Cl.
CPC ..... *G08G 1/0125* (2013.01); *G08G 1/052* (2013.01)

(58) Field of Classification Search
CPC ... G08G 1/0125; G08G 1/052; G08G 1/0104
USPC ..... 701/118
See application file for complete search history.

(56) References Cited

U.S. PATENT DOCUMENTS

2011/0010042 A1* 1/2011 Boulet ..... G08G 1/052 701/31.4
2011/0160988 A1* 6/2011 Rogers ..... G08G 1/0104 701/119
2012/0083995 A1* 4/2012 Vorona ..... G08G 1/0104 701/119

FOREIGN PATENT DOCUMENTS

CN 101840634 9/2010
CN 102176284 9/2011

(Continued)

*Primary Examiner* — Richard Camby
(74) *Attorney, Agent, or Firm* — Hamre, Schumann, Mueller & Larson, P.C.

(57) ABSTRACT

A method and device for monitoring real-time road condition is disclosed in the present invention, wherein, the method for monitoring real-time road condition comprises: obtaining the vehicle movement record information of the vehicle returned from the vehicle-mounted terminal; confirming and recording the current road condition information of the vehicle according to the vehicle movement record information, wherein, the current vehicle movement record information includes the road section where the vehicle is located, the current moving direction and the moving speed of the vehicle; judging whether N road conditions of other vehicles satisfied for judging conditions are recorded if the current moving speed of the vehicle is less than the predetermined speed threshold value, wherein, N is more than or equal to one, if N road conditions of other vehicles satisfied for judging conditions are recorded, judging that the road section where the vehicle is located is in a congested status. The technical solution provided by the present invention can achieve monitoring of real-time road condition and can save cost effectively.

10 Claims, 4 Drawing Sheets

(56) References Cited

FOREIGN PATENT DOCUMENTS

| | | |
|---|---|---|
| CN | 103500503 | 1/2014 |
| CN | 104036638 | 9/2014 |
| EP | 2713352 | 4/2014 |
| WO | 96/29688 | 9/1996 |

* cited by examiner

METHOD AND DEVICE FOR MONITORING REAL-TIME ROAD CONDITION

THCHNICAL FIELD

The present invention relates to the technical field of traffic information, and more particularly, relates to a method and device for monitoring real-time road condition.

BACKGROUND

As people's material living level improves, private car ownership rises year by year, more and more people buy cars for travel convenience. As the number of cars increases, correspondingly, roads become more and more crowded, and the density of cars on the roads become higher and higher. Duo to various reasons, the loss caused by traffic jams every year in China is about 170 billion RMB, and the number of the loss is increased year by year. If city road conditions can be monitored, measures can be adopted accordingly to avoid traffic jams from lasting for a long time when traffic jams happened on the road, and the traffic jam conditions on the road can be alleviated to certain extents.

At present, city road conditions are monitored by the following method: using tools including such as map coils, speed measuring radars and speed measuring cameras to collect road condition on main roads of a city, wherein, the road conditions include occupancy rates on the roads, traffic flows and speeds of vehicles.

Although the aforementioned scheme can achieve road condition surveillance of the main roads of the city, however, the main roads of the city need to be equipped with tolls such as speed measuring radars and speed measuring cameras, and so on, the cost of implementing the scheme (e.g., tool purchase cost and construction cost), is high.

BRIEF SUMMARY

A method and device for monitoring real-time road condition is provided in the present invention, which is configured for saving cost.

On one hand, the present invention provides a method for monitoring real-time road condition, which comprises:

obtaining vehicle movement record information of the vehicle returned from a vehicle-mounted terminal in the vehicle;

confirming and recording current road condition information of the vehicle according to the vehicle movement record information, wherein, the vehicle movement record information includes a road section where the vehicle is located currently, a current moving direction of the vehicle and a moving speed of the vehicle;

If the current moving speed of the vehicle is less than the predetermined threshold value, judging whether N road conditions of other vehicles satisfied for predetermined judging conditions are recorded, wherein, the number of N is more than or equal to one;

if N road conditions of other vehicles satisfied for the predetermined judging condition are recorded, determining that the road section where the vehicle locates is in a congested status;

wherein, the N road conditions of other vehicles satisfied for the condition include the following conditions: an interval between a time point of recording the road condition information and a time point of obtaining the vehicle movement record information is within a predetermined time threshold value, and the road section where the vehicle and the moving direction of the vehicle recorded in the road condition are the same as that of the vehicle where the vehicle-mounted terminal is mounted, and the moving speed of the vehicle recorded in the road condition is less than the predetermined speed threshold value.

On the other hand, the present invention provides a device for monitoring real-time road condition, which comprises:

an obtaining unit, configured for obtaining the vehicle movement record information of the vehicle returned from a vehicle-mounted terminal in the vehicle;

a confirming unit, configured for confirming the current road condition information of the vehicle according to the vehicle movement record information obtained by the obtaining unit, wherein, the vehicle movement record information includes a road section where the vehicle is located currently, a current moving direction of the vehicle and a moving speed of the vehicle;

a recording unit, configured for recording the current road condition information of the vehicle where the vehicle-mounted terminal is mounted;

a judging unit, configured for judging whether N road conditions of other vehicles satisfied for predetermined judging conditions are recorded by the recording unit if the current moving speed of the vehicle is less than the predetermined speed threshold value, wherein, the number of N is more than or equal to one; and a determining unit, configured for determining that the road section where the vehicle locates is in a congested status when N road conditions of other vehicles satisfied for the predetermined judging condition are recorded by the recording unit;

wherein, the N road conditions of other vehicles satisfied for the condition include the following conditions: an interval between a time point of recording the road condition information and a time point of obtaining the vehicle movement record information is within a predetermined time threshold value, and the road section where the vehicle and the moving direction of the vehicle recorded in the road condition are the same as that of the vehicle where the vehicle-mounted terminal is mounted, and the moving speed of the vehicle recorded in the road condition is less than the predetermined speed threshold value.

It is known from the above-mentioned technical solutions in the present invention that the present invention returns the vehicle movement record information of the vehicle by the vehicle-mounted terminal, confirms and records vehicle road condition information according to the vehicle movement record information, when moving speeds of a plurality of vehicles located on the same road section and having the same moving direction are all below the predetermined speed threshold value in the present invention, the road condition is regarded as being in a congested status. The present invention can realize the judgment for congested status of the road condition according to the vehicle movement record information returned from the vehicle-mounted terminal, compared with the existing road condition inspection schemes using tools such as map coils, speed measuring radars and speed measuring cameras, and so on, tool purchase cost, and construction investment cost is saved, so that the cost is saved effectively.

BRIEF DESCRIPTION OF THE DRAWINGS

In order to explain the embodiments of the present invention or the existing technical solutions more clearly, a brief introduction regarding the embodiments and the accompanying figures need to be used for describing in the prior art is given below, it is obvious that the accompanying figures described as follows are only part of the embodiments of the present invention, for those skilled in the art, some other accompanying figures can also be obtained on the premise of without paying creative labor.

DETAILED DESCRIPTION OF THE PREFERRED EMBODIMENT

In order to make the technical features, the propose and the technical effect of the present application be more clear, the present application will now be described in detail with reference to the accompanying drawings and embodiments. It is obvious that only part of embodiments described in the present invention, not all embodiments in the present invention are described. All the embodiments obtained by the one skilled in the art on the premise of without paying creative work are within the protecting scope of the present invention.

Figure 1:
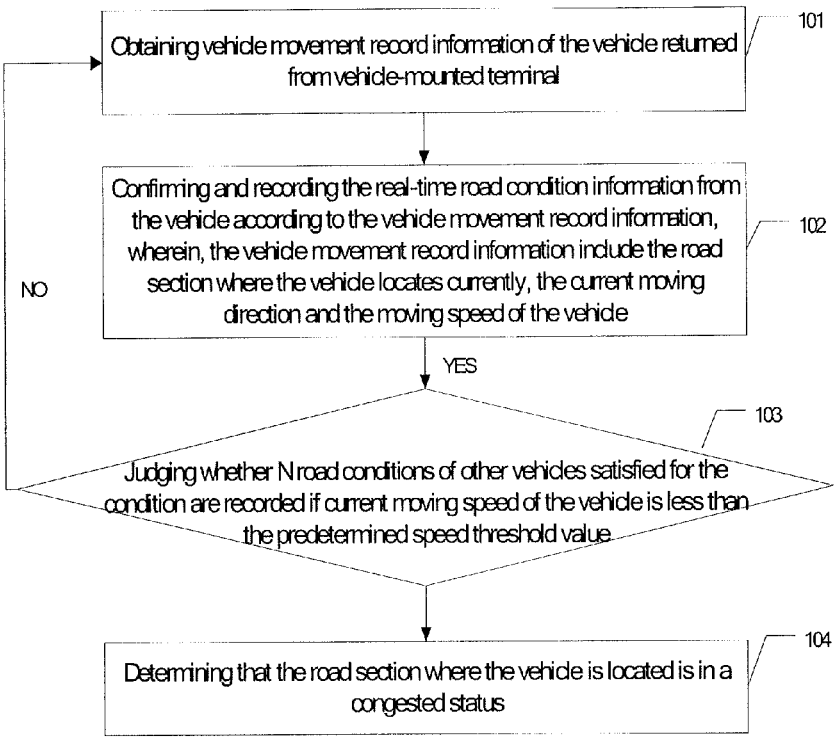
FIG. 1 illustrates a schematic flow chart of a method for monitoring real-time road condition in accordance with one embodiment of the present invention.

A method for monitoring real-time road condition in accordance with an embodiment of the present invention is described in the following, please refer to FIG. 1, the method for monitoring real-time road condition comprises:

Step 101, obtaining vehicle movement record information of a vehicle returned from a vehicle-mounted terminal mounted on the vehicle;

In the embodiment of the present invention, the vehicle movement record information of the vehicle equipped with the vehicle-mounted terminal is sent back to the server by the vehicle-mounted terminal periodically, or, the vehicle movement record information of the vehicle configured with the vehicle-mounted terminal is sent back to a server when the vehicle-mounted terminal detects that the moving speed of the vehicle is less than the predetermined speed threshold value. There is no limitation herein.

Preferably, the vehicle-mounted terminal in the embodiment of the present invention is a golo device, the golo device can collect various operating data from a whole system of a vehicle, wherein, the operating data includes failure information, data flow, position information, vehicle status and so on, thereby achieving various automobile applications, such as real-time remote diagnosis, vehicle professional examination, vehicle alarm warning, vehicle owner life community and map positioning service, and so on. In the embodiment of the present invention, a connector of the golo device is connected to an interface of On-Board Diagnostic interface of the vehicle to achieve the connection between golo device and the On-Board Diagnostic of the vehicle. The golo device collects signals sent out from an On-Board Diagnostic interface in real time when the golo device is connected to the On-Board Diagnostic interface of the vehicle, the signals include vehicle movement record information, the signal collected by golo device is analyzed and processed and then sent back to the server by the golo device. Specifically, the vehicle-mounted terminal in the embodiment of the present invention is golo 3 device, that is, the third generation golo device. As golo 3 device is supportive of WI-FI (wireless fidelity) network, thus, the golo3 device is able to send vehicle movement record information of the vehicle equipped with the golo 3 device back to the server via a wireless fidelity network.

Step 102, confirming and recording the current road condition information of above-mentioned vehicle according to the vehicle movement record information.

Wherein, the current vehicle road condition information includes the current road section of the vehicle, the current moving direction of the vehicle and the current moving speed of the vehicle.

In the embodiment of the present invention, the current road condition information of the vehicle according to the vehicle movement record is confirmed by the server after the vehicle movement record returned from the vehicle-mounted terminal is received, and the current road condition information of the vehicle is stored in a database. Preferably, in case the database has already stored previous road condition information of the vehicle, the previous road condition information of the vehicle stored in the database is replaced by current road condition information of the vehicle, so that the database is updated.

Step 103, if current vehicle moving speed is less than the predetermined speed threshold value, judging whether N road conditions satisfied for the condition regarding other vehicles are recorded.

Wherein, the number of N is equal to one or the number of N is more than one, the value of N is set in accordance with actual condition. N road conditions satisfied for the condition regarding other vehicles are as follows: the interval between the record time point of the road section and the record time point of the vehicle movement record information of the vehicle is within the predetermined time threshold value, and the road section recorded in the road condition and vehicle moving direction are the same as that of the vehicle which the terminal is mounted on, and the moving speed recorded in the road condition is less than the predetermined speed threshold value.

For example, supposing that the time point when the vehicle movement record information of vehicle A is obtained is ten past three, and the predetermined threshold value is five minutes, when the current moving speed of vehicle A is lower than the predetermined speed threshold value, the server searches the road condition information recorded in the time interval from five past three to fifteen past three when the current moving speed of vehicle A is low than the predetermined speed threshold value, if there exists N vehicle road condition information recorded in the time interval from five past three to fifteen past three, and the road section where N vehicles are located and the moving direction of N vehicles are the same as that of vehicle A, the server judges that N road condition information satisfied for the condition are recorded.

Preferably, in the step 101, when the vehicle movement record information of vehicle returned from vehicle-mounted terminal is obtained, the time point when the vehicle movement record information is obtained is recorded, and a time interval is delayed according to the predetermined time threshold value, the time interval is used for judging the road condition of the road section where vehicle A is located, For example, it is supposed that the time point when vehicle movement record information of vehicle A is obtained is then past three, the predetermined time threshold value is five minutes, five minutes is pushed backward, that is, the time interval, equaling from five past three to ten past three, is used for judging the road condition of the road section where vehicle A is located, the road condition information recorded during the aforementioned time interval is searched in database by the server, if there exists N records about road condition regarding N vehicles, and the road section where N vehicles is located and the moving direction of N vehicles are the same with that of vehicle A, the server judges that N road condition information satisfied for the condition regarding other vehicles are recorded.

Preferably, the threshold values may be different for different road section, that is, the speed threshold value can be set to be different values according to different road sections, and the step 103 is embodied as follows: the server judges whether the current moving speed of the vehicle is less than the predetermined speed threshold value in accordance with the road section where the vehicle is located, if yes, then judges whether N road condition information of other vehicles satisfied for the condition are recorded via the server, if no, return to the step 101, or, finishes the procedure immediately or after waiting for a predetermined time or when an predetermined incident happens.

Step 104, judging that the road section where the vehicle locates is in congested status.

Furthermore, the server can output the judgment result of procedure 104 after it judges that the road section where the vehicle locates is in congested status, so that measures to solute the road section congestion problem can be implemented.

Preferably, the server sends alert messages to all mobile terminals (e.g., mobile phones, tablet computers, vehicle-mounted terminal or other mobile terminals with the function of receiving data wirelessly) within monitoring scope of the server when or after it judges the road section where the vehicle locates is in congested status, the alert messages indicate that the road section is in congested status.

Preferably, the server sends alert messages to all mobile terminals located within a predetermined scope around the road section (for example, one to five kilometers around the road section) when or after it judges the road section where the vehicle locates is in congested status, the alert messages indicates that the road section is in congested status.

It is known that, in the present invention, the vehicle movement record information is returned from the vehicle-mounted terminal, the vehicle road condition information is confirmed and recorded according to the vehicle movement record information, and it is judged that the road section is in congested status when moving speeds of a plurality of vehicles on the road section with the same moving direction are all below the predetermined speed threshold value in the present invention. In the present invention, the judgment of congested status of road condition can be achieved merely via the vehicle movement record information returned from the vehicle-mounted terminal. Compared with the road condition inspection scheme via tools such as map coils, speed measuring radars and speed measuring cameras in prior art, tool purchase cost, and construction investment cost is saved, so that the cost is saved effectively. Furthermore, the mobile terminal within the scope is notified accordingly when it is judged that the road section is in congested status, so that part of car owners are able to keep away from the congested road section, on one hand, time and oil consumption of car owners can be saved, on the other hand, the traffic congestion level of the road section can be reduced effectively.

Figure 2:
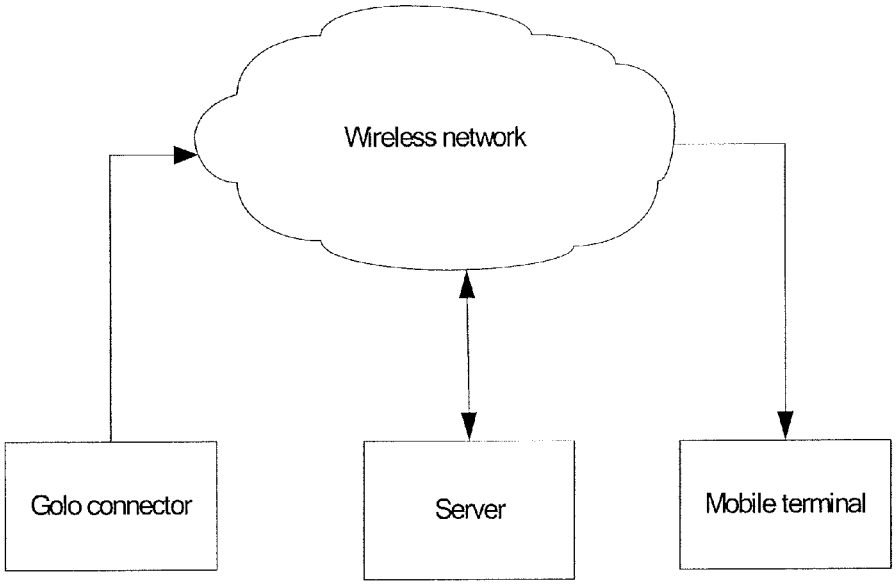
FIG. 2 illustrates an architectural schematic diagram of a system for monitoring real-time road condition in accordance with the present invention.

The method for monitoring real-time road condition of the present invention is described in a specified application scenarios below. FIG. 2 illustrates a structural schematic diagram of the real-time road condition monitoring system in the embodiment of the present invention, as shown in FIG. 2, a golo connector, a server, and a mobile terminal are connected each other via wireless network.

Figure 3:
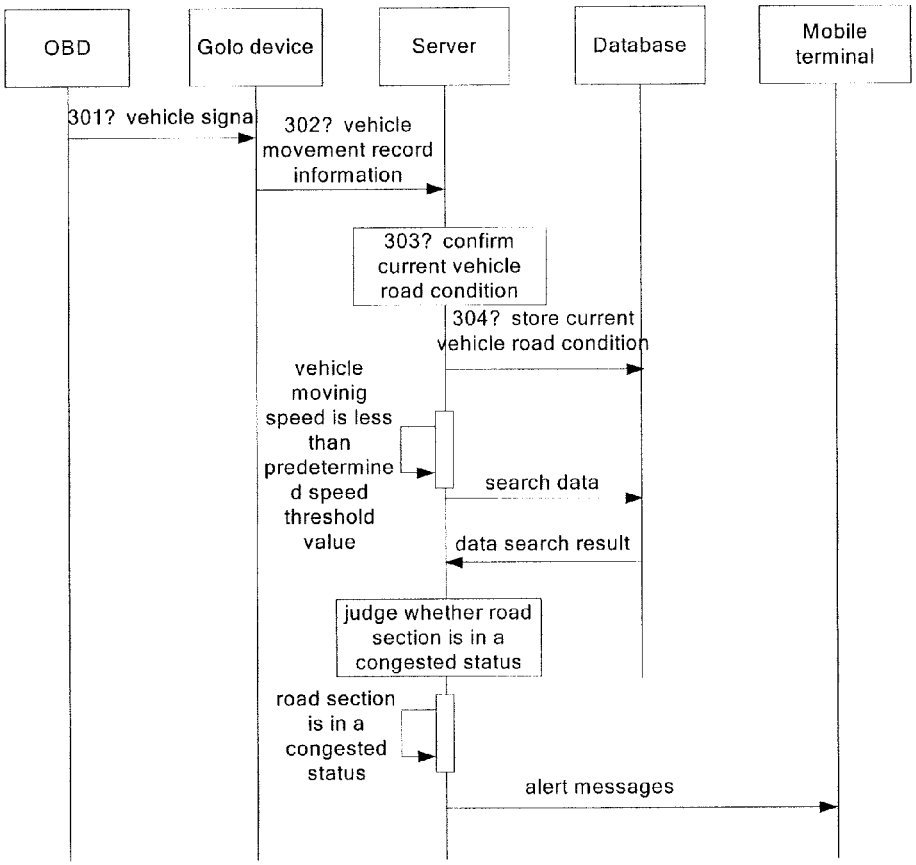
FIG. 3 illustrates a time sequence diagram of an application scenario of a method for monitoring real-time road condition in accordance with the present invention.

A sequence diagram of the method for monitoring real-time road condition is shown in FIG. 3:

Step 301, a vehicle signal is sent to a golo device by an On-Board Diagnostic interface;

Wherein, the vehicle signal includes vehicle moving record information.

It should be noted that the interface of the golo device needs to be insert into the On-Board Diagnostic interface of the vehicle to achieve the connection between the golo device and the OBD of vehicle before that the step 301.

Step 302, the vehicle movement record information is transmitted to the server via the golo device.

When the vehicle signal is received by the golo device, the vehicle signal is analyzed and the vehicle movement record information is sent to the server via a wireless data transmission mode.

Step 303, current road condition information of the aforementioned vehicle is confirmed and recorded according to the above-mentioned vehicle movement record information.

Wherein, the aforementioned current vehicle road condition information includes the current road section of the vehicle, the current moving direction of the vehicle and the current moving speed of the vehicle.

Step 304, the aforementioned current road condition information is stored in the database via the golo device.

Step 305, when the current moving speed of the vehicle is less than a predetermined speed threshold value, the vehicle data is searched in the database, and when the current vehicle moving speed is less than the predetermined speed threshold value, the server searches the road condition information of other vehicles satisfied for the condition in the database.

Wherein, the road conditions of other vehicles satisfied for the condition are embodied as follows: the interval between the record time point of the road section and the record time point of the vehicle movement record information of the vehicle is within the predetermined time threshold value, and the road section recorded in the road condition and vehicle moving direction are the same as that of the vehicle where the terminal is mounted, and the moving speed recorded in the road condition is less than the predetermined speed threshold value.

Procedure 306, a data search result is returned from the database.

Procedure 307, the server judges whether the current road section where the vehicle locates is in congested status according to data search result.

If the data search result returned by the database indicates that the number of road condition information of other vehicles are more than or equal to a predetermined value, the server judges the current road section where the vehicle locates is in a congested status, and if the data search result returned by database indicates that the number of road condition information of other vehicles are less than the predetermined value the server judges that the current road section where the vehicle locates isn't in the congested status.

Step 308, the server send alert messages to all mobile terminals (e.g., mobile phone, tablet computer, vehicle-mounted terminal or all the other mobile terminals with the function of wirelessly receiving data) when it judges that the road section where the vehicle locates currently is in a congested status.

Preferably, alert messages are sent out by the server to all mobile terminals within monitoring scope of the server when or after it is judged the road section where the vehicle locates is in congested status, the alert messages indicates the road section is in congested status, the mobile terminals comprise mobile phone, tablet computer, vehicle-mounted terminal or all the other mobile terminals with the function of data receiving in wireless network.

Preferably, the server sends alert messages to mobile terminals located within the predetermined scope around the road section (for example, one to five kilometers around the road section) when it judges that the road section where the vehicle locates is in a congested status.

The alert messages indicate that the road section is in the congested status.

Figure 4:
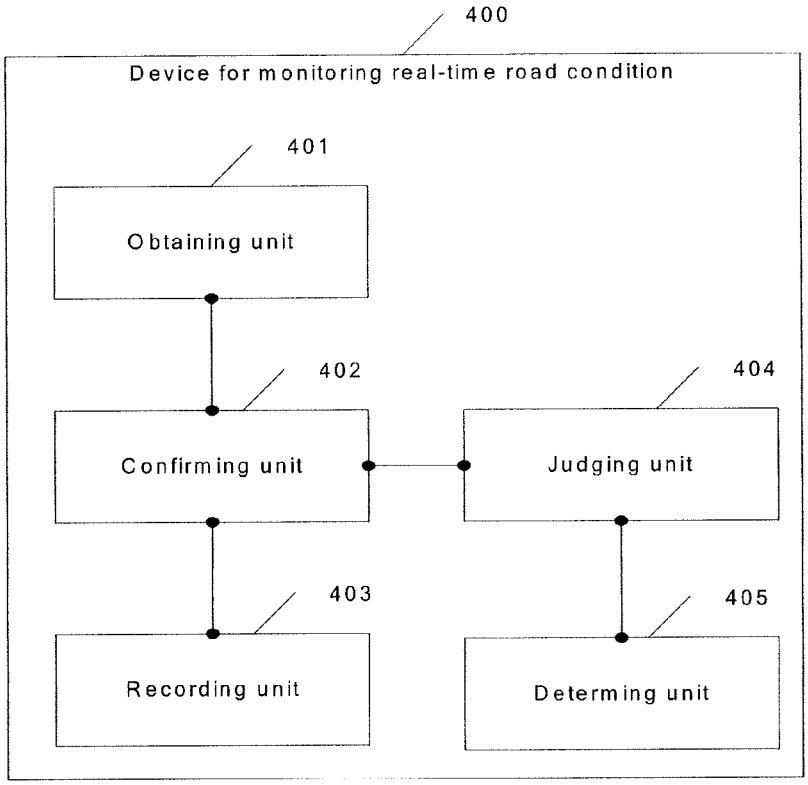
FIG. 4 illustrates a structural schematic diagram of a device for monitoring real-time road condition in accordance with one embodiment of the present invention.

A device for monitoring real-time road condition is also provided in the embodiment of the present invention, as shown in FIG. 4, the device for monitoring real-time road condition comprises:

an obtaining unit 401, configured for obtaining the vehicle movement record information of the vehicle returned from a vehicle-mounted terminal in the vehicle;

a confirming unit 402, configured for confirming the current road condition information of the vehicle according to the vehicle movement record information obtained by the obtaining unit 401, wherein, the vehicle movement record information includes a road section where the vehicle is located currently, a current moving direction of the vehicle and a moving speed of the vehicle;

a recording unit 403, configured for recording the current road condition information of the vehicle where the vehicle-mounted terminal is mounted;

a judging unit 404, configured for judging whether N road conditions of other vehicles satisfied for predetermined judging conditions are recorded by the recording unit 403 if the current moving speed of the vehicle is less than the predetermined speed threshold value, wherein, the number of N is more than or equal to one;

a determining unit 405, configured for determining that the road section where the vehicle locates is in a congested status when N road conditions of other vehicles satisfied for the predetermined judging condition are recorded by the recording unit 403;

wherein, the N road conditions of other vehicles satisfied for the condition include the following conditions: an interval between a time point of recording the road condition information and a time point of obtaining the vehicle movement record information is within a predetermined time threshold value, and the road section where the vehicle and the moving direction of the vehicle recorded in the road condition are the same as that of the vehicle where the vehicle-mounted terminal is mounted, and the moving speed of the vehicle recorded in the road condition is less than the predetermined speed threshold value.

Preferably, on the basis of the embodiment shown in FIG. 4, the device for monitoring real-time road condition further comprises a first alerting unit, which is configured for sending alert messages to all mobile terminals (e.g., mobile phone, tablet computer, vehicle-mounted terminal or all the other mobile terminals with the function of wirelessly receiving data) within a monitoring scope of the server, the alert messages indicates the road section is in congested status.

Preferably, on the basis of the embodiment shown in FIG. 4, the device for monitoring real-time road condition further comprises a second alerting unit, which is configured for sending alert messages to the mobile terminals located within a predetermined range around the road section where the vehicle is located, the alert message indicates that the road section where the mobile terminal is located is in the congested status.

Preferably, the vehicle-mounted terminal is a golo3 device. The obtaining unit 401 is specifically used for obtaining the vehicle movement record information of the vehicle returned from the golo3 device mounted on the vehicle, wherein, the connector of the golo3 device is connected to the interface of on-board diagnostic system. Preferably, the obtaining unit 401 is used specifically for obtaining vehicle movement record information of the vehicle returned from golo3 device mounted on the vehicle via a wireless fidelity network.

It should be noted that the device for monitoring real-time road condition in the embodiment of the present invention can be used to achieve all technical solutions in the aforementioned method embodiment, just as the server in the embodiment of the method embodiment, in regard to the specified implementing process of every function module, please refer to relevant description in aforementioned embodiment for the device for monitoring real-time road condition information, there is no need to repeat herein.

It is known that, in the present invention, the vehicle movement record information is returned from the vehicle-mounted terminal, the vehicle road condition information is confirmed and recorded according to the vehicle movement record information, and it is judged that the road section is in congested status when moving speeds of a plurality of vehicles on the road section with the same moving direction are all below the predetermined speed threshold value in the present invention. In the present invention, the judgment of congested status of road condition can be achieved merely via the vehicle movement record information returned from the vehicle-mounted terminal. Compared with the road condition inspection scheme via tools such as map coils, speed measuring radars and speed measuring cameras in prior art, tool purchase cost, and construction investment cost is saved, so that the cost is saved effectively. Furthermore, the mobile terminal within the scope is notified accordingly when it is judged that the road section is in congested status, so that part of car owners are able to keep away from the congested road section, on one hand, time and oil consumption of car owners can be saved, on the other hand, the traffic congestion level of the road section can be reduced effectively.

In the embodiments provided by the present invention, it should be understand that the apparatus and the method disclosed can be implemented via other ways. For example, the device embodiment described above is schematic merely, for example, the division of the units should be considered as logic function division merely, some other division methods can be applied in actual implementation, for example, a plurality of units or components can be combined or integrated into another system, or, some features can be ignored or unimplemented. On the other hand, mutual coupling or direct mutual coupling shown or discussed, or communication connection can be indirect coupling or communication connection via some interface, apparatus or units, the communication connection can be electrical connection or mechanical connection or some other form.

It should be noted that all the method embodiments mentioned above are described as motion combinations for convenience, it should be known those skilled in the art that the present invention should not be limited to the motion sequence described, this is because some other sequences can be adopted when some procedures are implemented or some procedures can be implemented at the same time in the present invention. Secondly, it should be known to those skilled in the art that the embodiments described in the explanation belong to preferable embodiments, the motion and the modules involved are not all necessary for the present invention.

In the embodiments mentioned above, the emphasis of every embodiment is different from other ones, when a part of an embodiment is not described in detail, please refer to relevant descriptions in other embodiments.

The method and device for monitoring real-time road condition are described above, for those skilled in the art, the specific embodiments and the application scope can be modified according to the idea of the present invention. To sum up, the content of the specification should not be understand as limitation of present invention.

The invention claimed is:

1. A method for monitoring real-time road condition, wherein the method comprises:

obtaining vehicle movement record information of the vehicle returned from a vehicle-mounted terminal in the vehicle;

confirming and recording current road condition information of the vehicle according to the vehicle movement record information, wherein, the vehicle movement record information includes a road section where the vehicle is located currently, a current moving direction of the vehicle and a moving speed of the vehicle;

if the current moving speed of the vehicle is less than the predetermined threshold value, judging whether N road conditions of other vehicles satisfied for predetermined judging conditions are recorded, wherein, the number of N is more than or equal to one;

if N road conditions of other vehicles satisfied for the predetermined judging condition are recorded, determining that the road section where the vehicle locates is in a congested status;

wherein, the N road conditions of other vehicles satisfied for the condition include the following conditions: an interval between a time point of recording the road condition information and a time point of obtaining the vehicle movement record information is within a predetermined time threshold value, and the road section where the vehicle and the moving direction of the vehicle recorded in the road condition are the same as that of the vehicle where the vehicle-mounted terminal is mounted, and the moving speed of the vehicle recorded in the road condition is less than the predetermined speed threshold value.

2. The method according to claim 1, wherein after judging that the road section where the vehicle locates is in the congested state, the method further comprises:

sending alert messages to all mobile terminals within the scope of monitoring, wherein, the alert message indicates that the road section where the vehicle equipped with the vehicle-mounted terminal is located is in the congested status.

3. The method according to claim 1, wherein after judging that the road section where the vehicle locates is in the congested state, the method further comprises:

sending alert messages to mobile terminals located within a predetermined range around the road section where the vehicle is located, wherein, the alert messages indicate that the road section where the mobile terminal is located is in the congested status.

4. The method according to claim 1, wherein the vehicle-mounted terminal is a golo3 device;

obtaining the vehicle movement record information of the vehicle returned from vehicle-mounted terminal includes:

obtaining the vehicle movement record information returned from the golo3 device mounted on the vehicle, wherein, the golo3 device is connected to an on-board diagnostic system of the vehicle.

5. The method according to claim 4, wherein, obtaining the vehicle movement record information returned from the golo3 device mounted on the vehicle includes:

obtaining the vehicle movement record information returned by the golo3 device mounted on the vehicle via a wireless fidelity network.

6. A device for monitoring real-time road condition, wherein, the device for monitoring real-time road condition comprises:

an obtaining unit, configured for obtaining the vehicle movement record information of the vehicle returned from a vehicle-mounted terminal in the vehicle;

a confirming unit, configured for confirming the current road condition information of the vehicle according to the vehicle movement record information obtained by the obtaining unit, wherein, the vehicle movement record information includes a road section where the vehicle is located currently, a current moving direction of the vehicle and a moving speed of the vehicle;

a recording unit, configured for recording the current road condition information of the vehicle where the vehicle-mounted terminal is mounted;

a judging unit, configured for judging whether N road conditions of other vehicles satisfied for predetermined judging conditions are recorded by the recording unit if the current moving speed of the vehicle is less than the predetermined speed threshold value, wherein, the number of N is more than or equal to one; and a determining unit, configured for determining that the road section where the vehicle locates is in a congested status when N road conditions of other vehicles satisfied for the predetermined judging condition are recorded by the recording unit;

wherein, the N road conditions of other vehicles satisfied for the condition include the following conditions: an interval between a time point of recording the road condition information and a time point of obtaining the vehicle movement record information is within a predetermined time threshold value, and the road section where the vehicle and the moving direction of the vehicle recorded in the road condition are the same as that of the vehicle where the vehicle-mounted terminal is mounted, and the moving speed of the vehicle recorded in the road condition is less than the predetermined speed threshold value.

7. The device for monitoring real-time road condition according to claim 6, wherein, the device for monitoring real-time road condition further comprises:

a first alerting unit, configured for sending alert message to all mobile terminals within the scope of the monitoring, the alert message indicates that the road section where the vehicle equipped with vehicle-mounted terminal is located is in the congested status.

8. The device for monitoring real-time road condition according to claim 6, wherein, the device for monitoring real-time road condition further comprises:

a second alerting unit, configured for sending alert messages to mobile terminals located within a predetermined range around the road section where the vehicle is located, the alert message indicates that the road section where the mobile terminals are located are in the congested status.

9. The device for monitoring real-time road condition according to claim 6, wherein, the vehicle-mounted terminal is a golo3 device;

the obtaining unit is configured for obtaining vehicle movement record information returned from the golo3 device mounted on the vehicle, wherein, the connector of the golo3 device is connected to the interface of an on-board diagnostic system.

10. The device for monitoring real-time road condition according to claim 9, wherein, the obtaining unit is configured for obtaining the vehicle movement record information of the vehicle returned from the golo3 device mounted on the vehicle via a wireless fidelity network.

* * * * *